US006210104B1

(12) United States Patent
Schönenborn

(10) Patent No.: US 6,210,104 B1
(45) Date of Patent: Apr. 3, 2001

(54) REMOVAL OF COOLING AIR ON THE SUCTION SIDE OF A DIFFUSER VANE OF A RADIAL COMPRESSOR STAGE OF GAS TURBINES

(75) Inventor: Harald Schönenborn, Wuppertal (DE)

(73) Assignee: Man Turbomaschinen AG GHH Borsig (DE)

( * ) Notice: Subject to any disclaimer, the term of this patent is extended or adjusted under 35 U.S.C. 154(b) by 0 days.

(21) Appl. No.: 09/255,626

(22) Filed: Feb. 22, 1999

(30) Foreign Application Priority Data

Apr. 21, 1998 (DE) ..... 198 17 705

(51) Int. Cl.[7] ..... F01D 5/14

(52) U.S. Cl. ..... 415/115; 415/206; 415/207; 415/208.3; 415/211.2

(58) Field of Search ..... 415/115, 203, 415/206, 207, 208.2, 208.3, 211.1, 211.2; 60/39.07, 751

(56) References Cited

U.S. PATENT DOCUMENTS

| | | | | |
|---|---|---|---|---|
| 4,005,572 | | 2/1977 | Giffhorn . | |
| 4,131,389 | * | 12/1978 | Perrone et al. | 415/221 |
| 4,182,117 | * | 1/1980 | Exley et al. | 60/39.07 |
| 4,368,005 | * | 1/1983 | Exley et al. | 415/207 |
| 4,431,374 | * | 2/1984 | Benstein et al. | 415/221 |
| 5,129,224 | | 7/1992 | Shekleton . | |

FOREIGN PATENT DOCUMENTS

| | | |
|---|---|---|
| 1199 541 | 12/1962 | (DE) . |
| 0666416 | 2/1952 | (GB) . |
| 1043168 | 9/1966 | (GB) . |
| 2041 149 | 9/1980 | (GB) . |

OTHER PUBLICATIONS

Mattingly, Jack D. 1996 *Elements of Gas Turbine Propulsion.*

* cited by examiner

*Primary Examiner*—Edward K. Look
*Assistant Examiner*—Ninh Nguyen
(74) *Attorney, Agent, or Firm*—McGlew and Tuttle, P.C.

(57) ABSTRACT

The removal of cooling air from the diffuser part of a radial stage of a compressor of a gas turbine is provided. The end stage of the compressor has a radial rotor disk (2) with a bladed diffuser (3). With the corresponding fastening elements (7) for the parts (20.1, 20.2) on the diffuser housing side, the diffuser blading (3) is used at the same time to connect the vane support (1) to the rear bearing housing (21). Compressed cooling air can be removed through either/both round holes (6.1) or/and slots (6.2), which are milled on the suction side of the diffuser vane (3). Through the removal openings (6.1, 6.2), the cooling air enters the blind holes (19) of the diffuser vane (3) and then further, through holes (19.1) in the diffuser housing outside (20.2), the cooling air discharge (10) arranged in the compressor housing.

9 Claims, 3 Drawing Sheets

REMOVAL OF COOLING AIR ON THE SUCTION SIDE OF A DIFFUSER VANE OF A RADIAL COMPRESSOR STAGE OF GAS TURBINES

FIELD OF THE INVENTION

The present invention pertains to the removal of cooling air from the diffuser part of a radial stage of a compressor of a gas turbine.

BACKGROUND OF THE INVENTION

In a gas turbine, which comprises a compressor, a combustion means and a turbine, cooling air, which is removed from the compressor under high pressure, is needed to cool the components that come into contact with hot gas.

In a gas turbine developed by the applicant, compressed air is removed from a radial stage of a compressor, which is an end stage in this case, through the suction-side side wall of the diffuser vane.

The compressed cooling air is removed from the compressor stage, which comprises a rotor disk and a diffuser, and is fed to a cooling air line arranged in the housing of the compressor. A deadwater or separation area, which compromises the efficiency of the entire compressor stage, frequently develops in such a diffuser in the suction-side, rear area of the flow channel due to the buildup of boundary layers on the diffuser vanes.

SUMMARY AND OBJECTS OF THE INVENTION

The primary object of the present invention is to design the removal of cooling air in the compressor part of a gas turbine such that favorable effects on the compressor efficiency are generated from a fluidic viewpoint.

According to the invention, removal of cooling air from the diffuser part of a radial stage of a compressor of a gas turbine is provided with at least one opening arranged in the horizontal blind holes on the suction side of the diffuser blading. Cooling air holes are led through the diffuser housing outside and they are connected to the cooling air discharge.

The openings may be designed as round openings. The openings may also be designed as slots.

The removal of cooling air is brought about by the device according to the present invention such that the compressed cooling air is removed through openings or slots from horizontally extending holes within the diffuser vane on the suction side of the diffuser vanes.

These horizontally arranged holes of the diffuser vanes are connected by analogous holes of the same type in the outside of the diffuser to the cooling air discharge in the compressor housing, so that the compressed cooling air is fed from the diffuser directly to the outside air channel. The boundary layer is thus drawn off on the suction side of the diffuser vanes. As a result, a deadwater area is prevented from forming or it is at least greatly reduced, which increases the efficiency of the entire stage.

On the whole, a deadwater area is avoided by the device according to the present invention, which leads to a reduction of the losses in the diffuser and to an increase in the efficiency of the stage.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
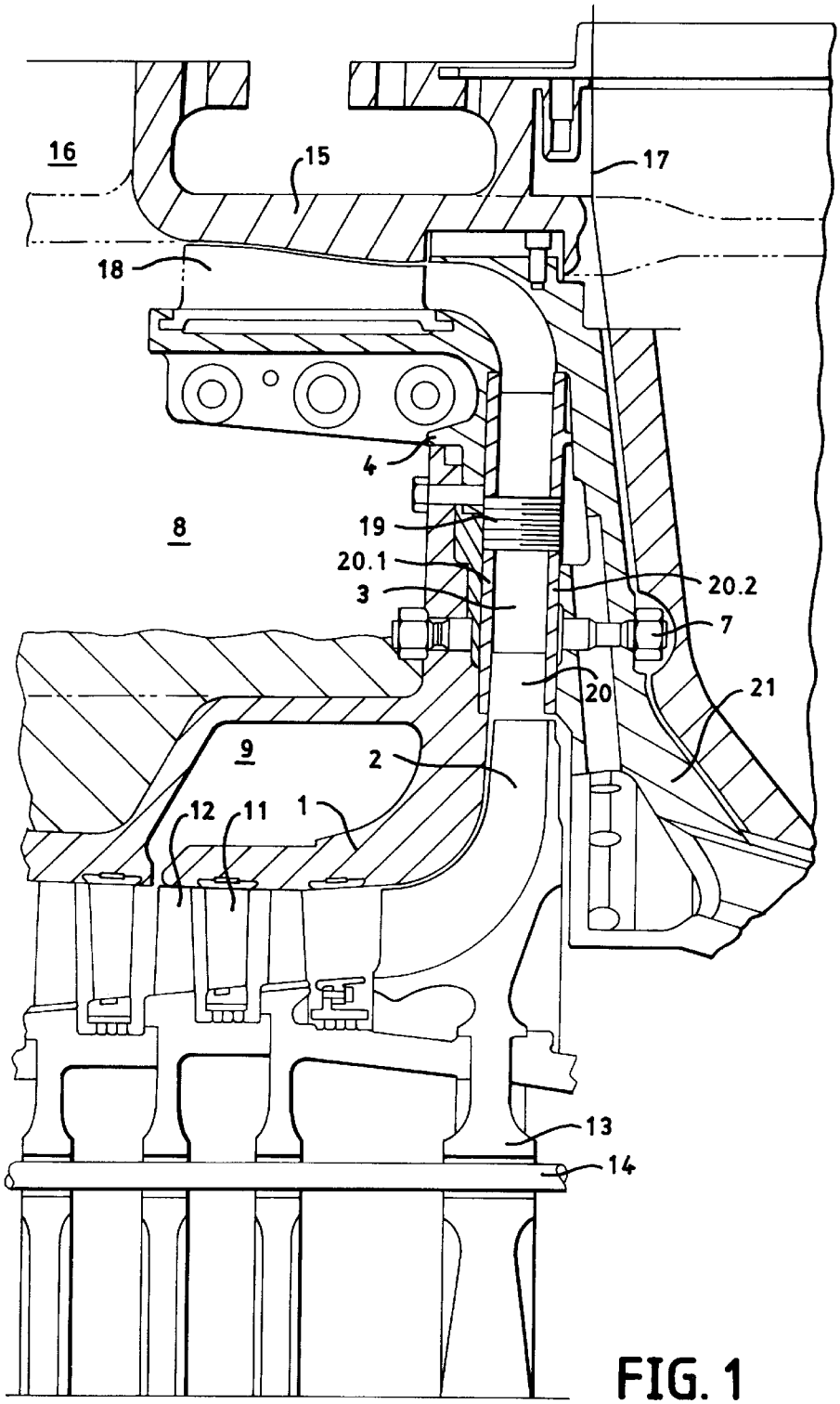
FIG. 1 is a schematic longitudinal sectional view through the compressor part of a gas turbine in the area of the diffuser.

Referring to the drawings in particular, FIG. 1 shows a longitudinal section through a compressor of a gas turbine with parts of the annular space 8, the vane support interior space 9, the compressor housing 15 and the discharge opening 16 for the compressed air, which is then fed to the combustion chamber. The rotor blades 12 of the compressor are fastened to the rotor disks 13, which are held together by a plurality of tie rods 14. Guide vanes 11 are fastened in the vane support 1. The end stage of the compressor comprises a radial stage with a radial rotor disk 2, a bladed diffuser 3 and an axial guide vane 18. The compressed air then enters the annular space 8. The diffuser 20 comprises the housing-side inner part 20.1 and the diffuser housing outside part 20.2 as well as the diffuser vanes 3 with inner horizontal blind holes 19.

In such a gas turbine, which comprises a compressor, a combustion means and a turbine, cooling air, which is taken from the compressor under high pressure, is needed to cool the components that come into contact with hot gas.

Figure 2:
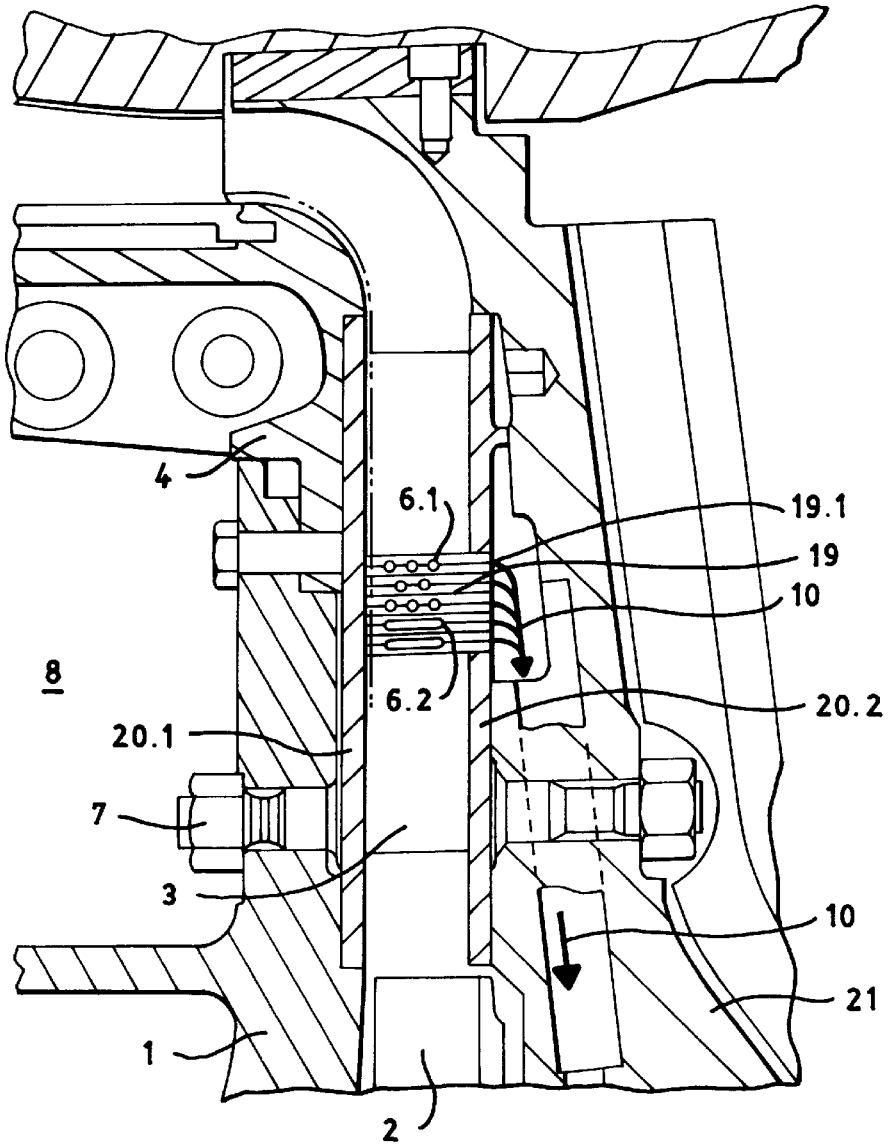
FIG. 2 is an enlarged view of the diffuser from FIG. 1 with various exemplary embodiments of the removal of cooling air.

FIG. 2 shows an enlarged view of the diffuser from FIG. 1. The diffuser blading 3 is used at the same time, with corresponding fastening elements 7, to connect the vane support 1 to the rear bearing housing 21. Compressed cooling air can be removed through both round openings 6.1 and slots 6.2, which are milled into the diffuser vane 3. Through the removal openings 6.1, 6.2, the cooling air enters the blind holes 19 of the diffuser vane 3 and then further, through holes 19.1 in the diffuser housing outside part 20.2, the cooling air discharge 10 arranged in the compressor housing.

Figure 3:
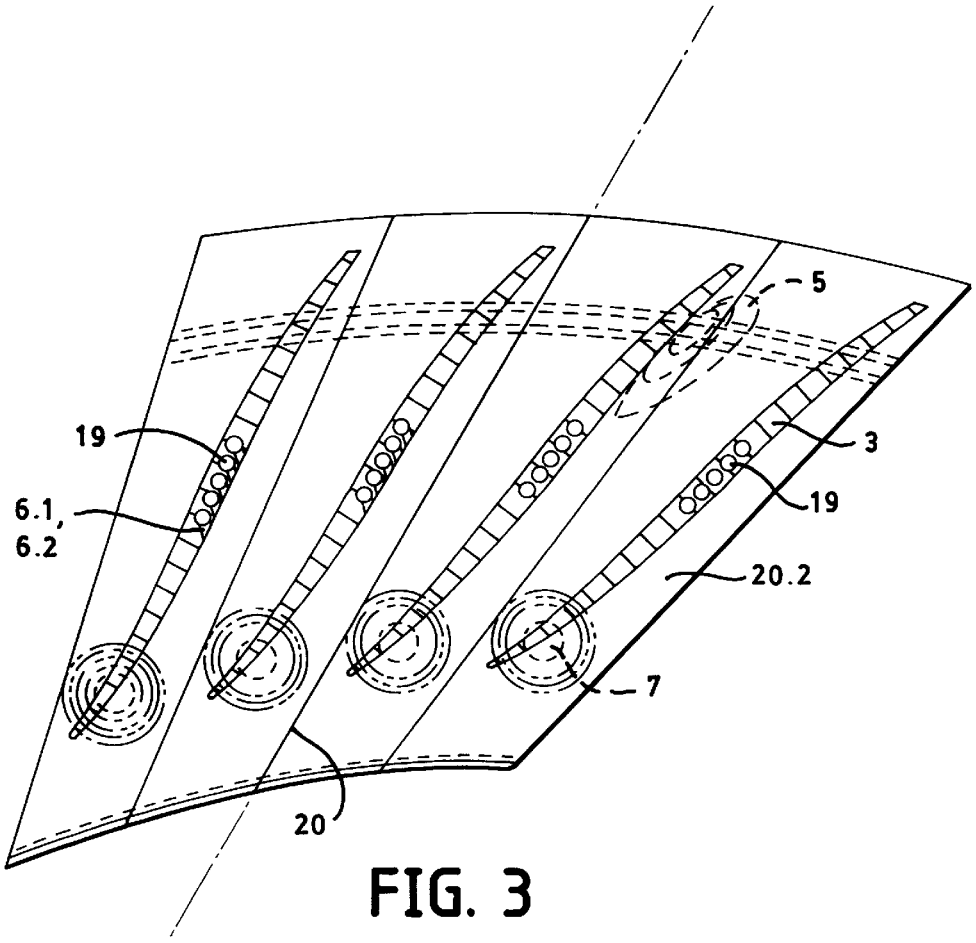
FIG. 3 is a cross section of the diffuser vane.

FIG. 3 shows a cross section through the diffuser 20 when viewed in the direction of the diffuser housing inside 20.1 with radially arranged diffuser vanes 3 with the cooling air discharges at the blind holes 19, which may be designed as holes 6.1 or slots 6.2. A deadwater area 5, indicated by broken lines in the right-hand part of FIG. 3, which reduces the efficiency of the entire compressor stage, cannot develop any more in this diffuser 20 in the suction-side, rear area of the flow channel.

The removal of cooling air is designed such that the cooling air is removed on the suction side of the diffuser vane 3 through suitable removal openings 6.1/6.2 in horizontally extending blind holes 19 and is fed through holes in the diffuser housing outside 20.2 and via the cooling air discharge in the housing to the components of the gas turbine that come into contact with the hot gas.

While specific embodiments of the invention have been shown and described in detail to illustrate the application of the principles of the invention, it will be understood that the invention may be embodied otherwise without departing from such principles.

What is claimed is:

1. A gas turbine radial compressor stage diffuser part with cooling air removal, the diffuser part comprising:

a diffuser blade including horizontal blind holes and at least one opening arranged connected to one of said horizontal blind holes on a suction side of said diffuser blade;

a diffuser housing outside part with cooling air holes led through said diffuser housing outside part;

a cooling air discharge connected to said cooling air holes.

2. The diffuser part according to claim 1, wherein said openings are round openings.

3. The diffuser part according to claim 1, wherein said openings are slots.

4. A gas turbine radial compressor stage, comprising:

a compressor housing with a discharge opening;

rotor blades fastened to respective rotor disks;

tie rods holding said rotor discs together;

a diffuser part with cooling air removal, the diffuser part including a plurality of diffuser blades having horizontal blind holes and at least one opening disposed on a suction side of said diffuser blade in fluid communication with one of said horizontal blind holes and a diffuser housing outside part with cooling air holes led through said diffuser housing outside part; and a cooling air discharge connected to said cooling air holes.

5. The compressor stage according to claim 4, wherein said openings are round openings.

6. The compressor according to claim 4, wherein said openings are slots.

7. A process for removing cooling air from a diffuser part of a gas turbine radial compressor stage, the process comprising the steps of:

providing a compressor with a housing with a discharge opening, rotor blades fastened to respective rotor disks and tie rods holding said rotor discs together;

providing a diffuser part with diffuser blades having horizontal blind holes and at least one opening arranged on a suction side of said diffuser blade in fluid communication with at least one of said horizontal blind holes and a diffuser housing outside part with cooling air holes led through said diffuser housing outside part; and connecting a cooling air discharge to said cooling air holes to remove cooling air from the diffuser part.

8. The process according to claim 7, wherein said openings are round openings.

9. The process according to claim 7, wherein said openings are slots.

* * * * *